US011477858B2

(12) United States Patent
Hanamachi et al.

(10) Patent No.: US 11,477,858 B2
(45) Date of Patent: *Oct. 18, 2022

(54) SHEATH HEATER

(71) Applicant: NHK SPRING CO., LTD., Kanagawa (JP)

(72) Inventors: Toshihiko Hanamachi, Kanagawa (JP); Kenji Sekiya, Kanagawa (JP); Daisuke Hashimoto, Kanagawa (JP); Satoshi Hirano, Kanagawa (JP); Masaru Takimoto, Kanagawa (JP); Go Takahara, Kanagawa (JP); Yoshihito Araki, Kanagawa (JP); Arata Tatsumi, Kanagawa (JP); Takashi Kawasaki, Ibaraki (JP); Yuki Toyama, Ibaraki (JP); Satoshi Anzai, Ibaraki (JP)

(73) Assignee: NHK SPRING CO., LTD., Kanagawa (JP)

( * ) Notice: Subject to any disclaimer, the term of this patent is extended or adjusted under 35 U.S.C. 154(b) by 239 days.

This patent is subject to a terminal disclaimer.

(21) Appl. No.: 16/653,094

(22) Filed: Oct. 15, 2019

(65) Prior Publication Data

US 2020/0045779 A1 Feb. 6, 2020

Related U.S. Application Data

(63) Continuation of application No. PCT/JP2018/014259, filed on Apr. 3, 2018.

(30) Foreign Application Priority Data

Apr. 12, 2017 (JP) ..... JP2017-078969

(51) Int. Cl.
*H05B 3/10* (2006.01)
*H05B 3/18* (2006.01)
(Continued)

(52) U.S. Cl.
CPC ..... *H05B 3/48* (2013.01); *H05B 3/03* (2013.01); *H05B 3/10* (2013.01); *H05B 3/18* (2013.01); *H05B 2203/014* (2013.01)

(58) Field of Classification Search
None
See application file for complete search history.

(56) References Cited

U.S. PATENT DOCUMENTS 5,844,205 A 12/1998 White et al.
6,035,101 A * 3/2000 Sajoto ..... C23C 16/46 392/416

(Continued)

FOREIGN PATENT DOCUMENTS

CN 201319673 Y 9/2009
CN 201766729 U 3/2011

(Continued)

OTHER PUBLICATIONS

JPH-06333666A, Soeda et al, Feb. 1999, "Sheath Heater," partial translation, same as JP-2857966 B2.*

(Continued)

*Primary Examiner* — Joseph M. Pelham
(74) *Attorney, Agent, or Firm* — Hauptman Ham, LLP

(57) ABSTRACT

A small diameter sheath heater with improved reliability is provided. The sheath heater according to one embodiment of the present invention includes a metal sheath, a heating wire having a band shape, the heating wire arranged with a gap within the metal sheath so as to rotate with respect to an axis direction of the metal sheath, an insulating material arranged in the gap, and connection terminals arranged at one end of the metal sheath, the connection terminals electrically connected with both ends of the heating wire respectively.

4 Claims, 6 Drawing Sheets

(51) Int. Cl.

| | |
|---|---|
| ***H05B 3/48*** | (2006.01) |
| ***H05B 3/74*** | (2006.01) |
| ***H05B 3/03*** | (2006.01) |

(56) References Cited

U.S. PATENT DOCUMENTS

| | | | | |
|---|---|---|---|---|
| 6,160,244 | A | 12/2000 | Ohashi | |
| 6,180,931 | B1 * | 1/2001 | Futakuchiya | H01L 21/67103 219/544 |
| 8,447,177 | B2 * | 5/2013 | Kusuda | H01L 21/68742 392/418 |
| 2001/0016115 | A1 | 8/2001 | Hirata et al. | |
| 2007/0257023 | A1 | 11/2007 | Watanabe et al. | |
| 2008/0197125 | A1 * | 8/2008 | Cui | H01L 21/67103 219/548 |
| 2008/0230535 | A1 | 9/2008 | Huang et al. | |
| 2013/0313246 | A1 * | 11/2013 | Long | H05B 3/52 219/544 |
| 2015/0114949 | A1 | 4/2015 | Lee | |
| 2016/0278164 | A1 | 9/2016 | Iida et al. | |
| 2017/0071033 | A1 * | 3/2017 | Schlipf | H05B 1/0297 |
| 2020/0043638 | A1 * | 2/2020 | Hanamachi | H01L 21/68792 |
| 2020/0045779 | A1 | 2/2020 | Hanamachi et al. | |
| 2021/0112632 | A1 * | 4/2021 | Schlipf | H05B 3/40 |
| 2021/0217638 | A1 * | 7/2021 | Hanamachi | C23C 14/50 |
| 2021/0235550 | A1 * | 7/2021 | Hanamachi | C23C 14/50 |
| 2021/0243849 | A1 * | 8/2021 | Boiger | C04B 33/26 |

FOREIGN PATENT DOCUMENTS

| | | | | |
|---|---|---|---|---|
| CN | 103096537 | A | 5/2013 | |
| CN | 103179703 | A | 6/2013 | |
| CN | 105594299 | A | 5/2016 | |
| GB | 363975 | A | 12/1931 | |
| GB | 2537715 | A * | 10/2016 | F24H 1/0018 |
| JP | S39-022480 | U | 8/1964 | |
| JP | S48-032038 | U | 10/1973 | |
| JP | S51-088853 | U | 1/1975 | |
| JP | S52-161342 | U | 12/1977 | |
| JP | S54-086756 | U | 12/1977 | |
| JP | S54-126146 | U | 2/1978 | |
| JP | S58-054517 | A | 3/1983 | |
| JP | S58-054577 | A | 3/1983 | |
| JP | H6-333666 | A | 12/1994 | |
| JP | 2710043 | B2 | 2/1998 | |
| JP | 2857966 | B2 * | 2/1999 | |
| JP | 2002-151239 | A | 5/2002 | |
| JP | 2009-091660 | A | 4/2009 | |
| JP | 2011-253692 | A | 12/2011 | |
| JP | 5095349 | B2 | 12/2012 | |
| JP | 2020047405 | A * | 3/2020 | |
| KR | 10-0702756 | B1 | 4/2007 | |
| KR | 10-0900001 | B1 | 5/2009 | |
| KR | 10-2010-0080765 | A | 7/2010 | |
| TW | 201448658 | A | 12/2014 | |

OTHER PUBLICATIONS

JPH-06333666A, Soeda et al, Feb. 1999, "Sheath Heater," Bibliographic data, same as JP-2857966 B2.*

Extended European Search Report issued for corresponding European Patent Application No. 18784228.1 dated Nov. 16, 2020.

Extended European Search Report issued for corresponding European Patent Application No. 18785237.1 dated Dec. 14, 2020.

Office Action issued for Japanese Patent Application No. 2017-078969 dated Jan. 5, 2021, along with an English machine translation.

Office Action issued for corresponding Chinese Patent Application No. 201880024404.0 dated Apr. 21, 2021, along with an English machine translation.

Office Action issued for corresponding Chinese Patent Application No. 201880024287.8 dated Apr. 21, 2021, along with an English machine translation.

Korean Office Action for corresponding Korean application No. KR10-2019-7030539 dated Jul. 16, 2020.

Korean Office Action for corresponding Korean application No. KR10-2019-7030535 dated Jul. 16, 2020.

Office Action issued for corresponding Japanese Patent Application No. 2017-078950 dated Jan. 26, 2021, along with an English machine translation.

International Search Report (PCT/ISA/210) dated Jun. 19, 2018 for the PCT application No. PCT/JP2018/014259 with partial English translation.

Written Opinion of the International Searching Authority (PCT/ISA/237) dated Jun. 19, 2018 for the PCT application No. PCT/JP2018/014259 with partial English translation.

International Search Report (PCT/ISA/210) dated Jun. 26, 2018 for the copending PCT application No. PCT/JP2018/014245 with partial English translation.

Written Opinion of the International Searching Authority (PCT/ISA/237) dated Jun. 26, 2018 for the copending PCT application No. PCT/JP2018/014245 with partial English translation.

Taiwanese Office Action dated Apr. 16, 2019 for the corresponding TW application No. 107112410 with partial English translation.

Taiwanese Office Action dated Apr. 15, 2019 for the copending TW application No. 107111615 with partial English translation.

Office Action dated Sep. 23, 2021 for co-pending U.S. Appl. No. 16/598,100.

Office Action dated Dec. 13, 2021 for corresponding Chinese Patent Application No. 201880024404.0, along with an English machine translation.

Office Action dated Dec. 13, 2021 for corresponding Chinese Patent Application No. 201880024287.8, along with an English machine translation.

Official Action dated Jun. 30, 2022, for European Patent Application No. 18784228.1.

* cited by examiner

SHEATH HEATER

CROSS REFERENCE TO RELATED APPLICATIONS

This application is based upon and claims the benefit of priority from the prior Japanese Patent Application No. 2017-078969 filed on Apr. 12, 2017. Further, this application is a continuation Application of International Application No. PCT/JP2018/014259, filed on Apr. 3, 2018. Both of the priority documents are hereby incorporated by reference.

FIELD

The present invention relates to a sheath heater. In particular, the present invention relates to a small diameter sheath heater.

BACKGROUND

A sheath heater generally has a heating wire held inside a metal tube shaped sheath, and an insulating material having high thermal conductivity is filled in a gap between the metal sheath and the heating wire. Since the surface of a heating element of the sheath heater is electrically insulated, it is possible for the sheath heater to directly heat a gas, liquid or metal and the like. In addition, it is possible for the sheath heater to have any shaped layout. Because of these conveniences it is used for various purposes. As a result, there is increasing demand for the sheath heaters having smaller diameter which can have more complex shaped layouts so as to meet various needs. On the other hand, since the sheath heater heats the heating wire by supplying electricity, it is necessary to come up with a means for improve the durability of the heating wire.

For example, a sheath heater arranged with a plurality of heating wires inside a single metal sheath is disclosed in the Japanese Patent Application Publication No. 2002-151239. Usually, heating is performed using one of a plurality of heating wires, and when this heating wire is disconnected, the power supply circuit is switched to another heating wire to recover easily and quickly.

SUMMARY

According to one embodiment of the present invention, a sheath heater is provided including a metal sheath, a heating wire having a band shape, the heating wire arranged with a gap within the metal sheath so as to rotate with respect to an axis direction of the metal sheath, an insulating material arranged in the gap, and connection terminals arranged at one end of the metal sheath, the connection terminals electrically connected with both ends of the heating wire respectively.

DESCRIPTION OF EMBODIMENTS

Figure 1A:
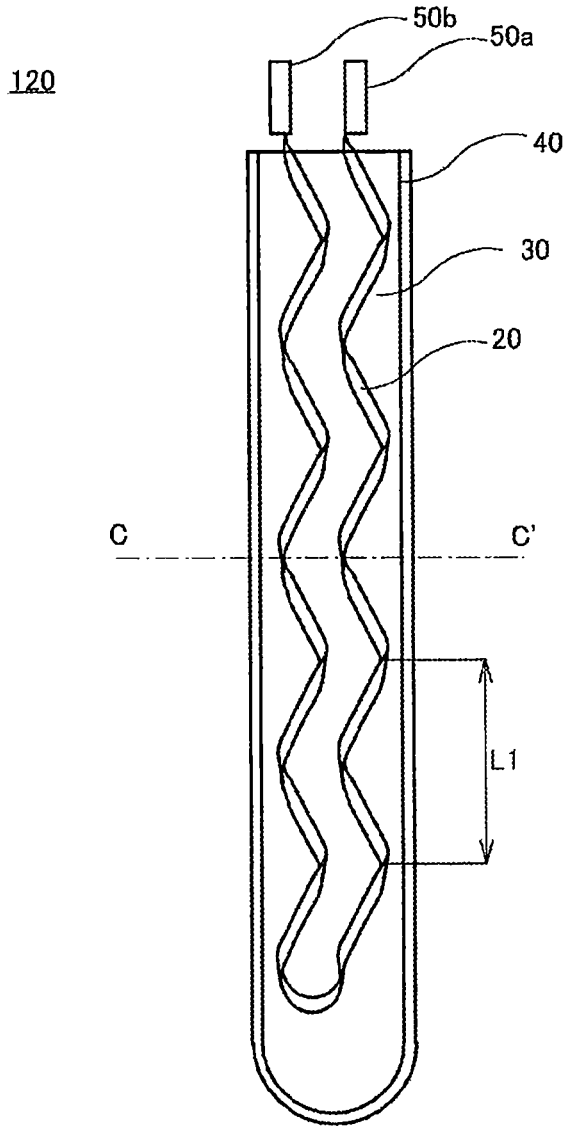
FIG. 1A is a cross-sectional structural diagram showing a sheath heater according to one embodiment of the present invention.

The sheath heater described in the Japanese Patent Application Publication No. 2002-151239 is arranged for disconnection of a heating wire, and no consideration is provided for suppressing the disconnection of the heating wire. In addition, there is no mention with regards to a reduction in the diameter of a sheath heater.

One of the objects of an embodiment of the present invention is to provide a small diameter sheath heater with improved reliability.

Hereinafter, each embodiment of the invention disclosed in the present application is explained below while referring to the drawings. However, the present invention can be implemented in various forms without departing from the gist of the invention and should not be construed as being limited to the description of the embodiments exemplified below.

In addition, although the drawings may be schematically represented with respect to the width, thickness and shape or the like of each part as compared with the actual embodiment in order to make the explanation clearer, they are merely examples and do not limit an interpretation of the invention. In addition, in the present specification and each drawing, elements which have the same functions as those described with reference to previous drawings may be denoted by the same reference numerals, and overlapping explanations may be omitted.

First Embodiment

Sheath Heater Structure

The structure of the sheath heater according to the first embodiment of the present invention is explained using FIG.

1A, FIG. 1B, and FIG. 2A to FIG. 2D. The sheath heater according to the first embodiment of the present invention includes a heating mechanism. In addition, the sheath heater according to the first embodiment can be used to directly heat gas, liquid or a metal and the like. However, the sheath heater according to the first embodiment is not limited to being used heating the objects described above.

Figure 1B:
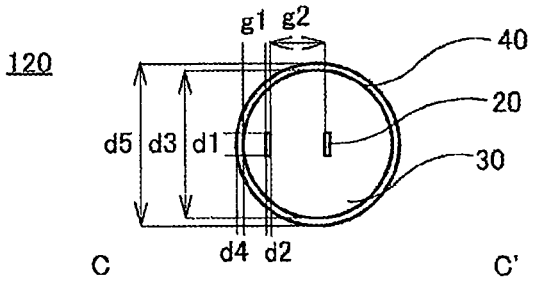
FIG. 1B is a cross-sectional structural diagram showing a sheath heater according to one embodiment of the present invention.

FIG. 1A and FIG. 1B are cross-sectional structural diagrams showing a sheath heater according to one embodiment of the present invention. As is shown in FIG. 1A and FIG. 1B, the sheath heater according to the first embodiment includes a band shaped heating wire 20, an insulating material 30, a metal sheath 40 and connection terminals 50.

Referring to FIG. 1A, the heating wire 20 is arranged with a gap within the cylindrical metal sheath 40. The heating wire 20 and the metal sheath 40 are insulated by the insulating material 30 which is arranged in the gap. Although the metal sheath 40 is shown as having a shape in which one end is closed in FIG. 1A, the shape is not limited to this and both ends may be open. The heating wire 20 is arranged so as to reciprocate in a cylindrical axis direction within the metal sheath 40, and both ends of the heating wire 20 are arranged at one end of the metal sheath 40. In other words, one heating wire 20 is arranged so as to be biaxial in most of the metal sheath 40 in a cylindrical axis direction. Each heating wire 20 which is arranged in the metal sheath 40 is arranged with a gap and is insulated by an insulating material 30 arranged in the gap.

FIG. 1B is a cross sectional diagram along the line C-C' in FIG. 1A. Referring to FIG. 1B, a width d1 of the band shaped heating wire 20 is preferred to be in a range of 0.1 mm or more and 2.0 mm or less. A thickness d2 of the band shaped heating wire 20 is preferred to be in a range of 0.1 mm or more and 0.5 mm or less. An inner diameter d3 of the metal sheath 40 is preferred to be in a range of 3.0 mm or more and 4.0 mm or less. A thickness d4 of the metal sheath 40 is preferred to be in a range of 0.5 mm or more and 1.0 mm or less. An outer diameter d5 of the metal sheath 40 is preferred to be in a range of 3.5 mm or more and 5.0 mm or less. Since the sheath heater 120 according to the present embodiment has the structure described above, it is possible to reduce the diameter while maintaining reliability. By reducing the diameter of the sheath heater 120, the sheath heater 120 can be laid out in a fine pattern shape.

A shortest distance g1 between the metal sheath 40 and each heating wire 20 which is arranged in the metal sheath 40 in a cross section orthogonal to the cylindrical axis is preferred to be in a range of 0.3 mm or more and 1.0 mm or less. The shortest distance g1 between the metal sheath 40 and the heating wire 20 is more preferably in a range of 0.4 mm or more and 1.0 mm or less. By setting the shortest distance g1 between the metal sheath 40 and the heating wire 20 to 0.3 mm or more, insulation between the metal sheath 40 and the heating wire 20 can be ensured. By setting the shortest distance g1 between the metal sheath 40 and the heating wire 20 to 1.0 mm or less, the diameter of the sheath heater 120 can be reduced. The diameter of sheath heater 120 according to the present embodiment can be reduced while maintaining reliability by using the band shaped heating wire 20. By reducing the diameter of the sheath heater 120, the sheath heater 120 can be laid out in a fine pattern shape.

A shortest distance g2 of each heating wire 20 arranged in the metal sheath 40 in a cross section orthogonal to the cylindrical axis is preferred to be in a range of 0.3 mm or more and 2.0 mm or less. The shortest distance g2 of each heating wire 20 arranged in the metal sheath 40 is more preferably in a range of 0.4 mm or more and 1.0 mm or less. By setting the shortest distance g2 of the biaxial heating wire 20 to 0.3 mm or more, the insulation of the heating wire 20 can be ensured. By setting the shortest distance g2 of the biaxial heating wire 20 to 2.0 mm or less, the diameter of the sheath heater 120 can be reduced. The diameter of sheath heater 120 according to the present embodiment can be reduced while maintaining reliability by using the band shaped heating wire 20. By reducing the diameter of the sheath heater 120, the sheath heater 120 can be laid out in a fine pattern shape.

Both ends of the heating wire 20 are arranged with a connection terminal 50*a* and a connection terminal 50*b* which are electrically connected respectively. Here, when the connection terminal 50*a* and the connection terminal 50*b* are not particularly distinguished, they are referred to as connection terminals 50. The sheath heater 120 of the present embodiment has a biaxial single-terminal structure in which two connection terminals 50 are arranged at one end of the sheath heater 120. One end of the sheath heater 120 including the connection terminals 50 is connected to an external device (heater controller, power source and the like). The sheath heater 120 is heated by electric power which is supplied from the external device which controls the temperature of the sheath heater 120.

The band shaped heating wire 20 is arranged so as to rotate with respect to the cylindrical axis direction of the metal sheath 40 in a region where the heating wire 20 is biaxial within the metal sheath 40. The band shaped heating wire 20 extends in the cylindrical axis direction in a state in which the long axis of the heating wire 20 rotates in a direction perpendicular to the cylindrical axis direction of the metal sheath 40. That is, each heating wire 20 is in a spiral shaped coiled state. The rotation axes of the biaxial heating wires 20 are arranged substantially parallel to the cylindrical axis direction of the metal sheath 40 respectively. By arranging the heating wire 20 in a coiled state, the length of the heating wire 20 arranged in the metal sheath 40 is increased and the resistance value of the sheath heater 120 can be increased. Furthermore, since the heating wire 20 has a spring property by being arranged in a coiled state, disconnection during thermal expansion is suppressed. As a result, for example, even if the difference in thermal expansion coefficient between the metal sheath 40 and the heating wire 20 is large, it is possible to provide the sheath heater 120 with improved reliability.

A rotation pitch L1 which is the length in the cylindrical length axis direction of the metal sheath 40 in which the heating wire 20 arranged in the metal sheath 40 rotates once in a spiral, is preferably 3.0 mm or less. The rotation pitch L1 of the heating wire 20 arranged in the metal sheath 40 is more preferably 2.5 mm or less, and more preferably 2.0 mm or less. By setting the rotation pitch L1 of the heating wire 20 arranged in the metal sheath 40 to 3.0 mm or less, it is possible to provide the sheath heater 120 with improved reliability by suppressing disconnection during thermal expansion.

Figure 2A:
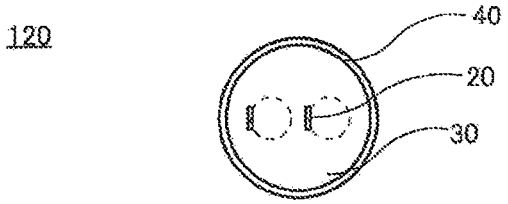
FIG. 2A is a cross-sectional structural diagram showing a sheath heater according to one embodiment of the present invention.
Figure 2B:
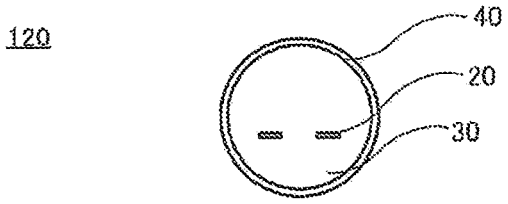
FIG. 2B is a cross-sectional structural diagram showing a sheath heater according to one embodiment of the present invention.
Figure 2C:
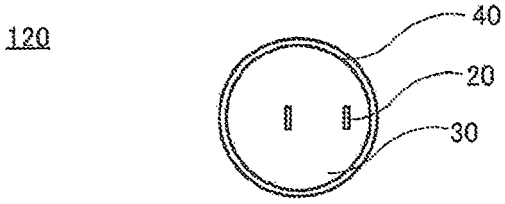
FIG. 2C is a cross-sectional structural diagram showing a sheath heater according to one embodiment of the present invention.
Figure 2D:
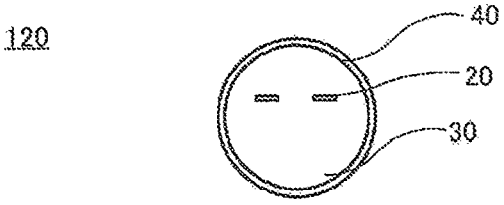
FIG. 2D is a cross-sectional structural diagram showing a sheath heater according to one embodiment of the present invention.

FIG. 2A to FIG. 2D are cross-sectional structural diagrams showing a sheath heater according to one embodiment of the present invention. FIG. 2A to FIG. 2D are cross-sectional diagrams of the sheath heater 120 which is shifted by a quarter pitch (L¼) in the cylindrical axis direction of the metal sheath 40. The arrangement of the heating wire 20 in the present embodiment is explained in detail using FIG. 2A to FIG. 2D. The dotted line in FIG. 2A shows the trajectory of the heating wire 20 when the heating wire 20 is rotated once in a spiral. Referring to FIG. 2A to FIG. 2D, when moved by a quarter pitch (L¼) in the cylindrical axis direction, each heating wire 20 rotates 90 degrees around the rotation axes. The rotation axes of each heating wire 20 are parallel to the cylindrical axis direction and are separated by the distance g2 of the biaxial heating wire 20.

A surface direction formed by the width d1 of the heating wire 20 is substantially perpendicular to a normal line of the rotation surface. That is, the surface of the band shaped heating wire 20 is a tangential plane of the rotation surface. Furthermore, the surface directions of the biaxial heating wire 20 are substantially parallel. The direction in which the central axis of each heating wire 20 rotates spirally in the direction of the cylindrical axis of the metal sheath 40 is substantially the same. The rotation pitch L1 is also the same. When the rotation direction and the rotation pitch L1 of each heating wire 20 are the same, the distance g2 between the biaxial heating wires 20 can be constantly maintained, and the reliability of the sheath heater 120 can be maintained. However, the present invention is not limited to this, and the rotation direction and/or the rotation pitch L1 of each heating wire 20 may be different. The sheath heater 120 according to the present embodiment is designed so that it is possible to maintain the reliability even if the rotation of the heating wire 20 is considered by meeting the conditions described above.

The cross-sectional shape of the sheath heater 120 according to the present embodiment is circular. Since the cross-sectional shape of the sheath heater 120 is circular, the sheath heater 120 can be easily bent into a desired shape. However, the cross-sectional shape of the sheath heater 120 is not limited to this, and can have any shape and can be transformed into any shape as long as the conditions described above are met.

A conductor which generates Joule heat when conducting can be used for the band shaped heating wire 20. Specifically, the conductor may include a metal selected from tungsten, tantalum, molybdenum, platinum, nickel, chromium and cobalt. The metal may be an alloy including these metals, for example, an alloy of nickel and chromium, or an alloy including nickel, chromium, and cobalt. In the present embodiment, a nickel-chromium alloy is used as the material of the heating wire 20.

The insulating material 30 is arranged to suppress the heating wire 20 from being electrically connected to other members. That is, a material that sufficiently insulates the heating wire 20 from other members can be used for the insulating material 30. Furthermore, the thermal conductivity of the material which is used for the insulating material 30 is preferred to be 10 W/mK or more. When the material used for the insulating material 30 has a thermal conductivity of 10 W/mK or more, the heat energy which is generated by the heating wire 20 can be efficiently transmitted to the metal sheath 40. As the insulating material 30, magnesium oxide, aluminum oxide, boron nitride, aluminum nitride or the like can be used. In the present embodiment, magnesium oxide (MgO) powder is used as the insulating material 30. The thermal conductivity of a compact powder of magnesium oxide (MgO) is about 10 W/mK.

The thermal conductivity of the material which is used for the metal sheath 40 is preferred to be 200 W/mK or more. When the thermal conductivity of the material used for the metal sheath 40 is 200 W/mK or more, the thermal energy generated by the heating wire 20 can be efficiently transmitted to the object to be heated.

Furthermore, the coefficient of thermal expansion of the material which is used for the metal sheath 40 is preferred to be $25\times10^{-6}$/K or less. In the present embodiment, aluminum is used as the material of the metal sheath 40. However, the material of the metal sheath 740 is not limited to aluminum and materials such as aluminum (Al), titanium (Ti) and stainless steel (SUS) can also be used. Since the thermal expansion coefficient of the material used for the metal sheath 40 is $25\times10^{-6}$/K or less, disconnection of the heating wire 20 due to the thermal expansion of the metal sheath 40 can be suppressed, and a sheath heater 120 with highly reliability can be provided.

As described above, the diameter of the sheath heater 120 according to the present embodiment can be reduced by including the band shaped heating wire 20. By reducing the diameter of the sheath heater 120, the sheath heater 120 with a fine pattern shaped layout can be provided. By arranging the band shaped heating wire 20 within the sheath heater 120 in a spiral rotated state, disconnection of the heating wire 20 during thermal expansion can be suppressed. For example, the sheath heater 120 with improved reliability can be provided even when the difference in coefficient of thermal expansion between the metal sheath 40 and the heating wire 20 is large.

Second Embodiment

Sheath Heater Structure

Figure 3A:
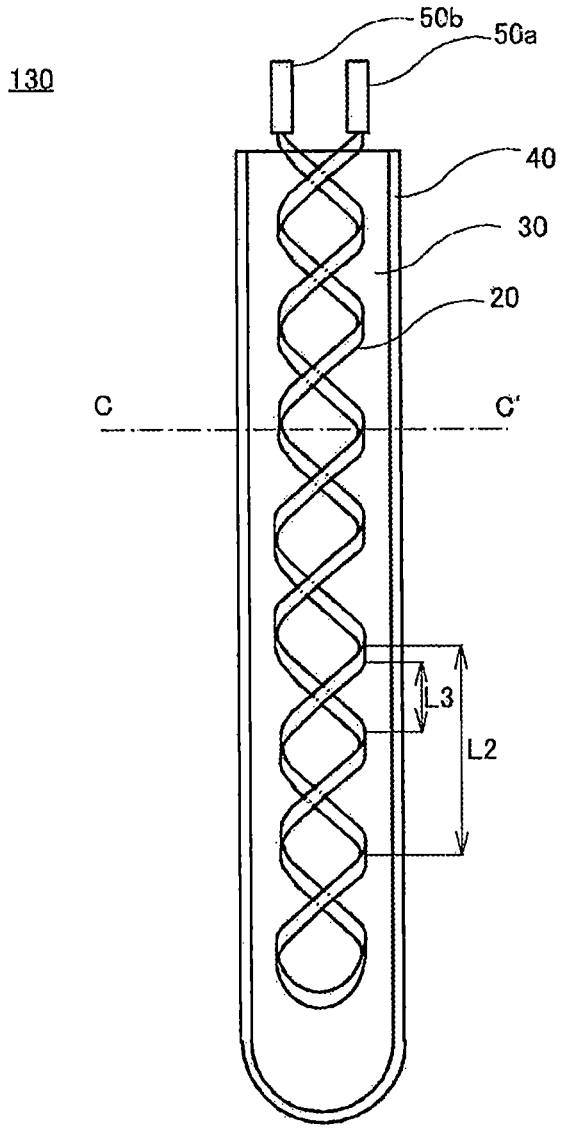
FIG. 3A is a cross-sectional structural diagram showing a sheath heater according to one embodiment of the present invention.
Figure 3B:
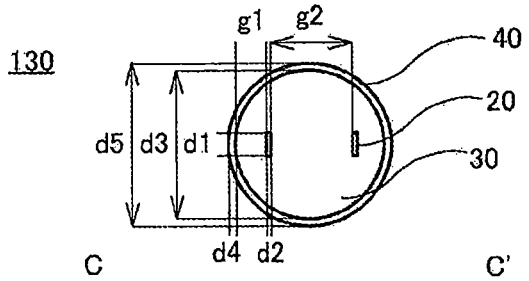
FIG. 3B is a cross-sectional structural diagram showing a sheath heater according to one embodiment of the present invention.

The structure of the sheath heater according to the second embodiment of the present invention is explained using FIG. 3A, FIG. 3B, and FIG. 4A to FIG. 4D. FIG. 3A and FIG. 3B are cross-sectional structural diagrams showing a sheath heater according to one embodiment of the present invention. As is shown in FIG. 3A and FIG. 3B, the sheath heater according to the second embodiment includes a band shaped heating wire 20, an insulating material 30, a metal sheath 40 and connection terminals 50 the same as in the first embodiment. Since the sheath heater 130 according to the second embodiment is the same in the first embodiment except for the arrangement of the heating wire 20 in the metal sheath 40, an explanation of the overlapping structure and composition is omitted and mainly the differences are explained.

Referring to FIG. 3A, the heating wire 20 is arranged with a gap within the cylindrical metal sheath 40. The heating wire 20 and the metal sheath 40 are insulated by the insulating material 30 which is arranged in the gap. Although the metal sheath 40 is shown in FIG. 3A in a shape in which one end is closed, the present embodiment is not limited to this, and the metal sheath 40 may be in a shape in which both ends are open. The heating wire 20 is arranged so as to reciprocate in the cylindrical axis direction within the metal sheath 40, and both ends of the heating wire 20 are arranged at one end of the metal sheath 40. That is, one heating wire 20 is arranged so as to be biaxial in most of the metal sheath 40 in the cylindrical axis direction. Each heating wire 20 which is arranged in the metal sheath 40 is arranged with a gap and is insulated by the insulating material 30 which is arranged in the gap.

FIG. 3B is a cross-sectional diagram along the line C-C' in FIG. 3A. Referring to FIG. 3B, the width dl of the band shaped heating wire 20 is preferred to be in a range of 0.1 mm or more and 2.0 mm or less. The thickness d2 of the band shaped heating wire 20 is preferred to be in a range of 0.1 mm or more and 0.5 mm or less. The inner diameter d3 of the metal sheath 40 is preferred to be in a range of 3.0 mm or more and 4.0 mm or less. The thickness d4 of the metal sheath 40 is preferred to be in a range of 0.5 mm or more and 1.0 mm or less. The outer diameter d5 of the metal sheath 40 is preferred to be in a range of 3.5 mm or more and 5.0 mm or less. By providing the sheath heater 130 according to the present embodiment with the structure described above, it is possible to reduce the diameter while maintaining reliability. By reducing the diameter of the sheath heater 130, the sheath heater 130 can be laid out in a fine pattern shape.

The shortest distance g1 between the metal sheath 40 and each heating wire 20 which is arranged in the metal sheath 40 in a cross section orthogonal to the cylindrical axis is preferred to be in a range of 0.3 mm or more and 1.0 mm or less. The shortest distance g1 between the metal sheath 40 and the heating wire 20 is more preferably in a range of 0.4 mm or more and 1.0 mm or less. By setting the shortest distance g1 between the metal sheath 40 and the heating wire 20 to 0.3 mm or more, insulation between the metal sheath 40 and the heating wire 20 can be ensured. By setting the shortest distance g1 between the metal sheath 40 and the heating wire 20 to 1.0 mm or less, the diameter of the sheath heater 130 can be reduced. By using the band shaped heating wire 20, the diameter of the sheath heater 130 according to the present embodiment can be reduced while maintaining reliability. By reducing the diameter of the sheath heater 130, the sheath heater 130 can be laid out in a fine pattern shaped layout.

The shortest distance g2 between each heating wire 20 arranged in the metal sheath 40 is preferred to be in a range of 0.3 mm or more and 2.0 mm or less in a cross section which is orthogonal to the cylindrical axis. The shortest distance g2 between each heating wire 20 arranged in the metal sheath 40 is more preferably in a range of 0.4 mm or more and 1.0 mm less. By setting the shortest distance g2 between the biaxial heating wires 20 to 0.3 mm or more, the insulation of the heating wire 20 can be ensured. By setting the shortest distance g2 of the biaxial heating wires 20 to 2.0 mm or less, the diameter of the sheath heater 130 can be reduced. By using the band shaped heating wire 20, the diameter of the sheath heater 130 according to the present embodiment can be reduced while maintaining reliability. By reducing the diameter of the sheath heater 130, the sheath heater 130 can be laid out in a fine pattern shape.

Both ends of the heating wire 20 are arranged with a connection terminal 50*a* and a connection terminal 50*b* which are electrically connected respectively. Here, when the connection terminal 50*a* and the connection terminal 50*b* are not particularly distinguished, they are referred to as connection terminals 50. The sheath heater 130 of the present embodiment has a biaxial single-terminal structure in which the two connection terminals 50 are arranged at one end of the sheath heater 130. One end of the sheath heater 130 including the connection terminals 50 is connected to an external device (heater controller, power source and the like). The sheath heater 130 is heated by electric power which is supplied from the external device which controls the temperature of the sheath heater 130.

The band shaped heating wire 20 is arranged so as to rotate with respect to the cylindrical axis direction of the metal sheath 40 in a region where the heating wire 20 is biaxial within the metal sheath 40. The band shaped heating wire 20 extends in the cylindrical axis direction in a state where the long axis of the heating wire 20 rotates in a direction perpendicular to the cylindrical axis direction of the metal sheath 40. Furthermore, the rotation axes of each heating wire 20 are arranged in a state where they substantially match. That is, the biaxial heating wire 20 is coiled in a double helix shape. The rotation axis of the biaxial heating wire 20 is arranged substantially parallel to the cylindrical axis direction of the metal sheath 40. By arranging the heating wire 20 in a coiled state, the length of the heating wire 20 arranged within the metal sheath 40 is increased, and the resistance value of the sheath heater 130 can be increased. Furthermore, since the heating wire 20 provided with spring properties by being arranged in a coiled state, disconnection during thermal expansion is suppressed. As a result, for example, it is possible to provide the sheath heater 130 with improved reliability even if the difference in the coefficient of thermal expansion between the metal sheath 40 and the heating wire 20 is large.

A rotation pitch L2, which is the length in the cylindrical length axis direction of the metal sheath 40 in which the heating wire 20 arranged in the metal sheath 40 rotates once in a spiral, is preferred to be 6.0 mm or less. The rotation pitch L2 of the heating wire 20 which is arranged in the metal sheath 40 is more preferably 2.5 mm or less, and even more preferable 2.0 mm or less. By setting the rotation pitch L2 of the heating wire 20 which is arranged in the metal sheath 40 to 6.0 mm or less, it is possible to provide the sheath heater 130 with improved reliability by suppressing disconnection during thermal expansion. Furthermore, it is preferred that the shortest distance L3 in the rotation axis direction of each heating wire 20 is 2.3 mm or more in the region where the heating wire 20 is biaxial in the metal sheath 40. By setting the distance L3 of the biaxial heating wires 20 to 2.3 mm or more, insulation of the heating wire 20 can be ensured.

Figure 4A:
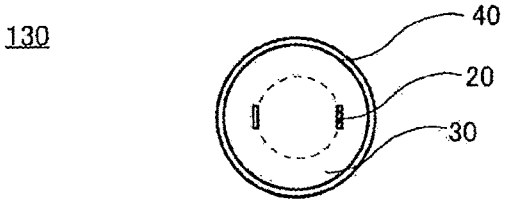
FIG. 4A is a cross-sectional structural diagram showing a sheath heater according to one embodiment of the present invention.
Figure 4B:
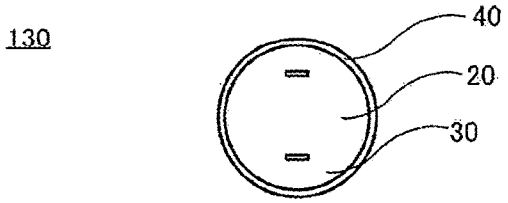
FIG. 4B is a cross-sectional structural diagram showing a sheath heater according to one embodiment of the present invention.
Figure 4C:
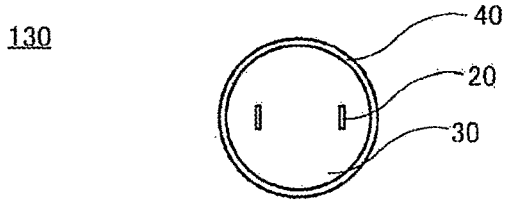
FIG. 4C is a cross-sectional structural diagram showing a sheath heater according to one embodiment of the present invention.
Figure 4D:
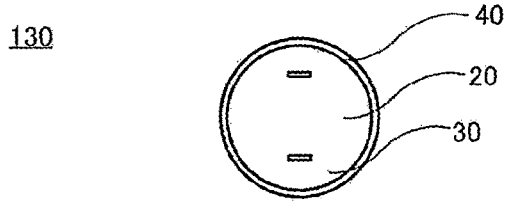
FIG. 4D is a cross-sectional structural diagram showing a sheath heater according to one embodiment of the present invention.

FIG. 4A to 4D are cross-sectional structural diagrams showing a sheath heater according to one embodiment of the present invention. FIG. 4A to FIG. 4D are cross-sectional diagrams of the sheath heater 130 which is shifted by a quarter pitch (L¾) in the cylindrical axis direction of the metal sheath 40. The arrangement of the heating wire 20 in the present embodiment is explained in detail using FIG. 4A to FIG. 4D. The dotted line in FIG. 4A shows the trajectory of the heating wire 20 when the heating wire 20 rotates spirally once. Referring to FIG. 4A to FIG. 4D, when moving by a quarter pitch (L¾) in the cylinder axis direction, each heating wire 20 rotates 90 degrees around the same rotation axis. The rotation axis of the heating wire 20 is parallel to the cylindrical axis direction.

A surface direction formed by the width d1 of the heating wire 20 is substantially perpendicular to a normal line of the rotation surface. That is, the surface of the band shaped heating wire 20 is a tangential plane of the rotation surface. Furthermore, the surface directions of the biaxial heating wire 20 are substantially parallel. The direction in which the central axis of each heating wire 20 rotates in a double helix spiral in the direction of the cylindrical axis of the metal sheath 40 is misaligned by 180 degrees. The rotation pitch L2 is substantially the same. That is, the rotation of each heating wire 20 is misaligned by one half pitch. When the rotation pitch L2 of each heating wire 20 are the same, the distance g2 between the biaxial heating wires 20 can be constantly maintained, and the reliability of the sheath heater 130 can be maintained. However, the present invention is not limited to this, and the misalignment of the rotation direction of each heating wire does not have to be 180 degrees. The sheath heater 130 according to the present embodiment is designed so that it is possible to maintain reliability even if the rotation of the heating wire 20 is considered as long as the condition that the shortest distance L3 of the biaxial heating wire 20 in the cylindrical axis direction of the metal sheath 40 is g2 or more is met.

The cross-sectional shape of the sheath heater 130 according to the present embodiment is circular. Since the cross-sectional shape of the sheath heater 130 is circular, the sheath heater 130 can be easily bent into a desired shape. However, the cross-sectional shape of the sheath heater 130 is not limited to this shape, and can have any shape, and can be deformed into any shape as long as the conditions described above are met.

As described above, the diameter of the sheath heater 130 according to the present embodiment can be reduced by including the band shaped heating wire 20. By reducing the diameter of the sheath heater 130, the sheath heater 130 with a fine pattern shaped layout can be provided. By arranging the band shaped heating wire 20 in the sheath heater 130 in a double helix shape, disconnection of the heating wire 20 during thermal expansion can be suppressed. For example, the sheath heater 130 with improved reliability can be provided even if there is a large difference in the coefficient of thermal expansion between the metal sheath 40 and the heating wire 20.

Each embodiment described above as embodiments of the present invention can be implemented in combination as appropriate as long as they do not contradict each other. In addition, those skilled in the art could appropriately add, delete or change the design of the constituent elements based on the each embodiment, as long as it does not depart from the concept of the present invention and such changes are included within the scope of the present invention.

In addition, even if other actions and effects different from the actions and effects brought about by the aspects of each embodiment described above are obvious from the description of the present specification or those which could be easily predicted by those skilled in the art, such actions and effects are to be interpreted as being provided by the present invention.

EXAMPLES

Although the present invention is explained in more detail below based on examples and comparative examples, the present invention is not limited thereto, and can be appropriately modified without departing from the gist of the present invention.

Example 1

Figure 5:
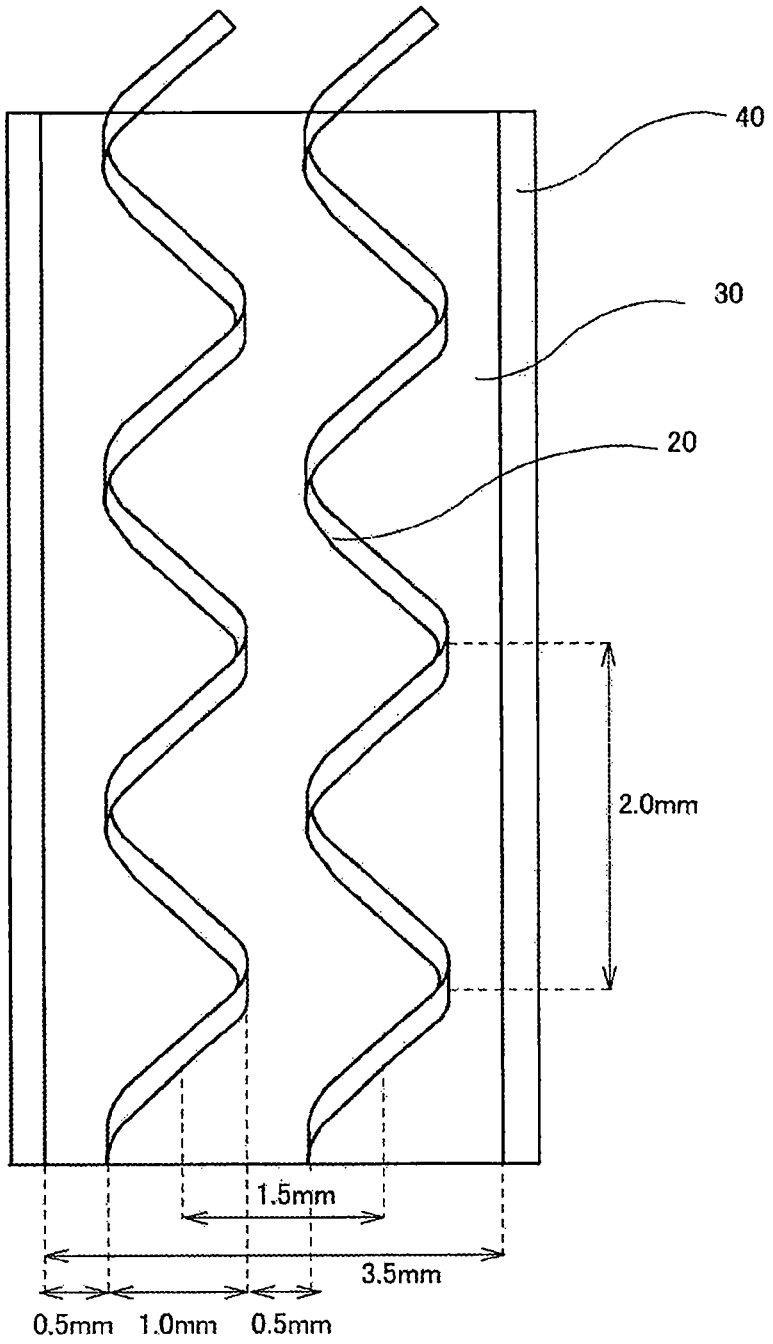
FIG. 5 is a cross-sectional structural diagram showing a sheath heater according to an Example 1 of the present invention.

FIG. 5 is a cross-sectional structural diagram showing the sheath heater according to Example 1 of the present invention. Example 1 has substantially the same structure as in the first embodiment described above, and each parameter is as follows.

Material of the heating wire 20: nickel-chromium alloy (nickel 80%, chromium 20%)

Width d1 of heating wire 20: 1 mm

Thickness d2 of heating wire 20: 0.1 mm

Shortest distance between biaxial heating wires 20: 0.5 mm

Distance between rotating shafts of the heating wire 20: 1.5 mm

Rotational diameter of the heating wire 20: 1 mm

Rotational pitch L1 of the heating wire 20: 2 mm

Minimum distance between the metal sheath 40 and the heating wire 20: 0.5 mm Material of metal sheath 40: aluminum Inner diameter d3 of metal sheath 40: 3.5 mm Thickness d4 of metal sheath 40: 0.5 mm Outer diameter d5 of metal sheath 40: 4.5 mm

Comparative Example 1

Since the Comparative Example 1 has the same structure as Example 1 except that a round heating wire 20 is used, an explanation of the same structure is omitted.

Material of the heating wire 20: nickel-chromium alloy (nickel 80%, chromium 20%)

Diameter of round heating wire: ϕ0.4 mm

Evaluation by Resistance Value

The resistance values in the sheath heaters of Example 1 and Comparative Example 1 described above were measured. The resistance value in the sheath heater of Example 1 was 5 to 40 Ω/m. On the other hand, the resistance value in the sheath heater of Comparative Example 1 was 170 Ω/m or more. In the sheath heater obtained by coiling the band in Example 1, output per unit length could be increased.

Evaluation by CT Scan

Figure 6A:
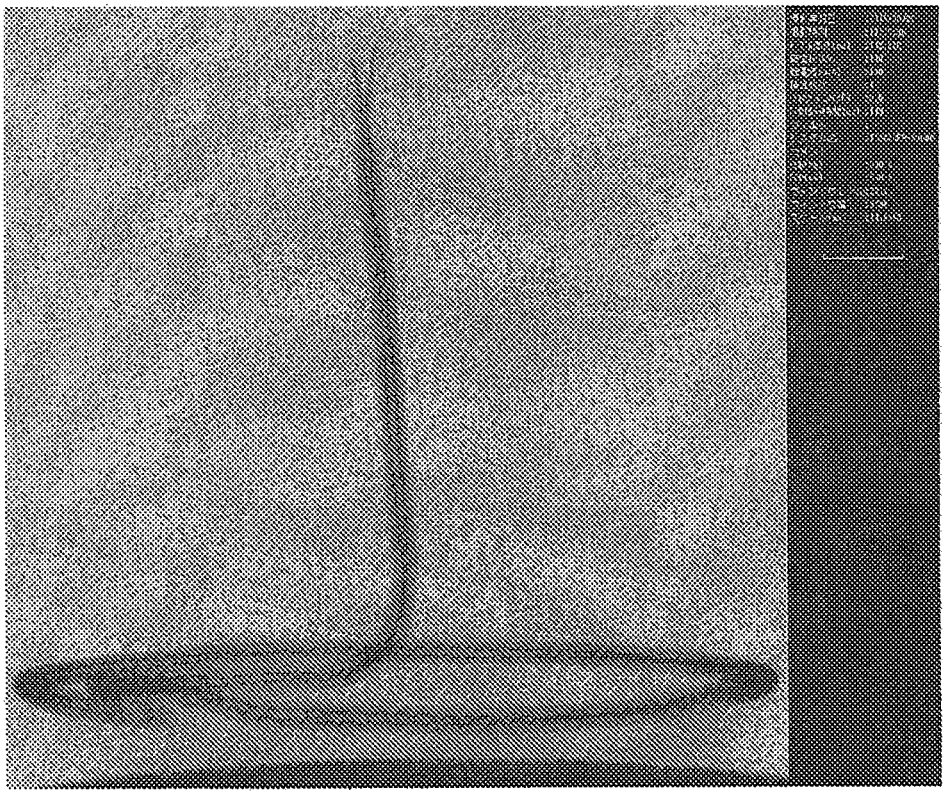
FIG. 6A is a CT scan image of the sheath heater according to Example 1 of the present invention.
Figure 6B:
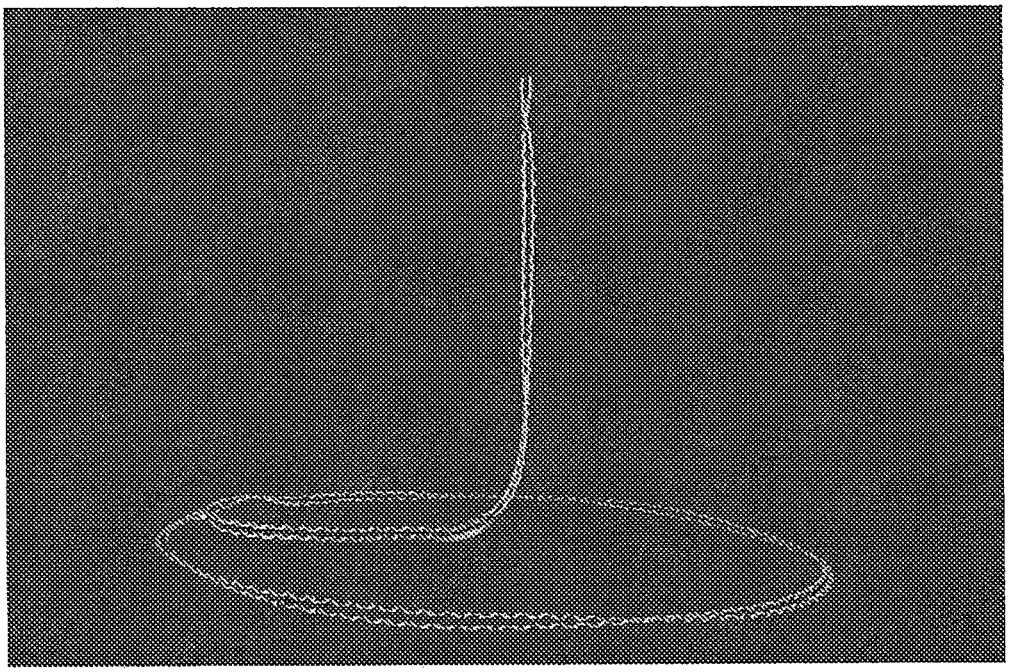
FIG. 6B is a 3D image of the sheath heater according to Example 1 of the present invention.

The sheath heaters in Example 1 and Comparative Example 1 described above were observed by a CT scan. FIG. 6A shows a CT scan image of the sheath heater according to the Example 1. FIG. 6B shows a 3D image of the sheath heater according to the Example 1. As is shown in FIG. 6A and FIG. 6B, in the sheath heater in Example 1, an insulation distance between the coiled band shaped heating wire and the metal sheath, and the insulation distance between pairs of heating wires could be ensured of 0.41 mm or more. On the other hand, in the sheath heater of the Comparative Example 1, sections were observed where an insulation distance between a coiled round heating wire and the metal sheath and the insulation distance between pairs of heating wires was 0.2 mm or less. In the band shaped coiled sheath heater in Example 1, it was possible to perform coiling while ensuring insulation within a small diameter metal sheath.

What is claimed is:

1. A sheath heater comprising:

a metal sheath;

a heating wire having a band shape, the heating wire being separated from the metal sheath so as to form a helical structure about an axis parallel to an axial direction of the metal sheath, and being arranged in a double helix structure so as to form a biaxial region in the metal sheath;

an insulating material arranged between the heating wire and the metal sheath; and connection terminals arranged at one end of the metal sheath, the connection terminals electrically connected with both ends of the heating wire respectively, wherein surface directions formed by a width of the biaxial heating wire are substantially parallel, and a rotation direction of each helix of the heating wire is substantially the same and a rotation pitch is substantially the same.

2. The sheath heater according to claim 1, wherein the insulating material is an inorganic insulating powder.

3. The sheath heater according to claim 1, wherein the metal sheath is aluminum, the heating wire is a nickel-chrome alloy, and the insulating material is magnesium oxide.

4. The sheath heater according to claim 1, wherein the rotation axes of each helix of the heating wire are arranged in a state where they substantially match so that the biaxial heating wire is coiled having the double helix structure.

* * * * *